US010516218B2

(12) United States Patent
Ding et al.

(10) Patent No.: US 10,516,218 B2
(45) Date of Patent: Dec. 24, 2019

(54) DUAL-BAND RADIATION SYSTEM AND ANTENNA ARRAY THEREOF

(71) Applicant: Tongyu Communication Inc., Zhongshan, Guangdong (CN)

(72) Inventors: Can Ding, Zhongshan (CN); Yingjie Guo, Zhongshan (CN); Peiyuan Qin, Zhongshan (CN); Zhonglin Wu, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 15 days.

(21) Appl. No.: 16/072,306

(22) PCT Filed: Nov. 9, 2016

(86) PCT No.: PCT/CN2016/105177
§ 371 (c)(1),
(2) Date: Jul. 24, 2018

(87) PCT Pub. No.: WO2018/086006
PCT Pub. Date: May 17, 2018

(65) Prior Publication Data

US 2019/0036226 A1 Jan. 31, 2019

(51) Int. Cl.

| | |
|---|---|
| ***H01Q 19/18*** | (2006.01) |
| ***H01Q 1/52*** | (2006.01) |
| ***H01Q 15/00*** | (2006.01) |
| ***H01Q 19/10*** | (2006.01) |
| ***H01Q 21/26*** | (2006.01) |

(Continued)

(52) U.S. Cl.
CPC ..... *H01Q 19/18* (2013.01); *H01Q 1/521* (2013.01); *H01Q 5/307* (2015.01); *H01Q 15/0086* (2013.01); *H01Q 19/108* (2013.01); *H01Q 21/26* (2013.01); *H01Q 21/30* (2013.01)

(58) Field of Classification Search
CPC ..... H01Q 19/18; H01Q 5/307; H01Q 21/30; H01Q 21/26; H01Q 19/108; H01Q 15/0086; H01Q 1/521; H01Q 21/24; H01Q 21/00; H01Q 19/106; H01Q 19/104; H01Q 1/36
See application file for complete search history.

(56) References Cited

U.S. PATENT DOCUMENTS 5,451,969 A 9/1995 Toth et al.
7,271,778 B1 9/2007 Nagai
(Continued)

FOREIGN PATENT DOCUMENTS

WO 2012/159406 A1 11/2012

OTHER PUBLICATIONS

Jul. 6, 2017 International Search Report issued in International Patent Application No. PCT/CN2016/105177.
(Continued)

*Primary Examiner* — Trinh V Dinh
(74) *Attorney, Agent, or Firm* — Oliff PLC

(57) ABSTRACT

A radiation system includes a low-frequency radiator having a bowl-shaped structure, a high-frequency radiator arranged inside the bowl-shaped structure of the low-frequency radiator, and a metamaterial reflector arranged below the high-frequency radiator. The metamaterial reflector includes a metasurface arranged below the high-frequency radiator and a solid metal plane arranged below the metasurface.

20 Claims, 5 Drawing Sheets

(51) Int. Cl.
*H01Q 21/30* (2006.01)
*H01Q 5/307* (2015.01)

(56) References Cited

U.S. PATENT DOCUMENTS

| | | | | |
|---|---|---|---|---|
| 2004/0140942 | A1* | 7/2004 | Gottl | H01Q 13/10 343/810 |
| 2008/0129626 | A1 | 6/2008 | Wu et al. | |
| 2012/0044118 | A1* | 2/2012 | Lee | H01Q 1/246 343/795 |
| 2013/0187822 | A1* | 7/2013 | Shi | H01Q 1/246 343/821 |
| 2013/0342409 | A1 | 12/2013 | Tatarnikov et al. | |
| 2014/0247194 | A1 | 9/2014 | Durnan et al. | |
| 2015/0288065 | A1* | 10/2015 | Liu | H01Q 1/246 343/835 |
| 2018/0034165 | A1* | 2/2018 | Aleksandrovich | H01Q 21/26 |

OTHER PUBLICATIONS

Jul. 6, 2017 Writen Opinion of the International Searching Authority issued in International Patent Application No. PCT/CN2016/105177.

* cited by examiner

DUAL-BAND RADIATION SYSTEM AND ANTENNA ARRAY THEREOF

TECHNICAL FIELD

The disclosure generally relates to a radiation system and, more particularly, to a radiation system working in two wavelength bands and an antenna array thereof.

BACKGROUND ART

Communication technologies of several different generations are concurrently used in the mobile communication area. For example, second generation (2G) and third generation (3G) networks now co-exist in the mobile communication network. To provide services to customers of different networks, a mobile communication base station needs to have the capability of communicating in different frequencies, i.e., in different wavelength bands. Therefore, a radiation and/or receiving structure, e.g., an antenna, used in the mobile communication base station may need to include radiation units associated with different frequencies for use in different networks, such as a radiation structure having both a high-frequency unit and a low-frequency unit, also referred to as a dual-band radiation structure.

Technical Problem

An object of the present invention is to provide a dual-band radiation system including a low-frequency radiator and a high-frequency radiator therein, of which the overall height of the radiation system can be reduced, and a good isolation can be provided between the low-frequency radiator and the high-frequency radiator.

Another object of the present invention is to provide an antenna array with the dual-band radiation systems, which has a reduced size and good radiation performance.

SOLUTION TO PROBLEM

Technical Solution

To achieve the above object, a dual-band radiation system provided in the present invention comprises a low-frequency radiator having a bowl-shaped structure, a high-frequency radiator arranged inside the bowl-shaped structure of the low-frequency radiator, and a metamaterial reflector arranged below the high-frequency radiator and inside the bowl shape structure of the low-frequency radiator. The metamaterial reflector includes a metasurface arranged below the high-frequency radiator and a solid metal plane arranged below the metasurface.

Also in accordance with the disclosure, there is provided an antenna array including at least one dual-band radiation unit and at least one single-band radiation unit arranged alternately. Each of the at least one dual-band radiation unit includes a low-frequency radiator having a bowl-shaped structure, a first high-frequency radiator arranged inside the bowl-shaped structure of the low-frequency radiator, and a first metamaterial reflector arranged below the first high-frequency radiator and inside the bowl shape structure of the low-frequency radiator. The first metamaterial reflector includes a first metasurface arranged below the first high-frequency radiator and a first solid metal plane arranged below the first metasurface. Each of the at least one single-band radiation unit includes a second high-frequency radiator and a second meta-material reflector arranged below the second high-frequency radiator. The second metamaterial reflector includes a second metasurface arranged below the second high-frequency radiator and a second solid metal plane arranged below the second metasurface.

ADVANTAGEOUS EFFECTS OF INVENTION

Advantageous Effects

The present invention has advantages that: the metamaterial reflector can reflect most of the radiation of the high-frequency radiator toward a direction away from the low-frequency radiator, form a good magnetic conductor for radiation within a certain frequency band, i.e., within the working frequency band of the high-frequency radiator, thus provide isolation between the low-frequency radiator and the high-frequency radiator, improve the radiation performance of the high-frequency radiator, and specifically increase the gain of the high-frequency radiator. Further, the metamaterial reflector has very little influence on the radiation performance of the low-frequency radiator, that is, with the use of the metamaterial reflector, the radiation performance of the high-frequency radiator can be improved without sacrificing the radiation performance of the low-frequency radiator. Moreover, because of the metamaterial reflector, the high-frequency radiator can be arranged inside the bowl-shaped structure of the low-frequency radiator, and thus the overall height of the radiation system can be reduced.

Features and advantages consistent with the disclosure will be set forth in part in the description which follows, and in part will be obvious from the description, or may be learned by practice of the disclosure. Such features and advantages will be realized and attained by means of the elements and combinations particularly pointed out in the appended claims.

BRIEF DESCRIPTION OF DRAWINGS

Description of Drawings

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

Figure 1A:
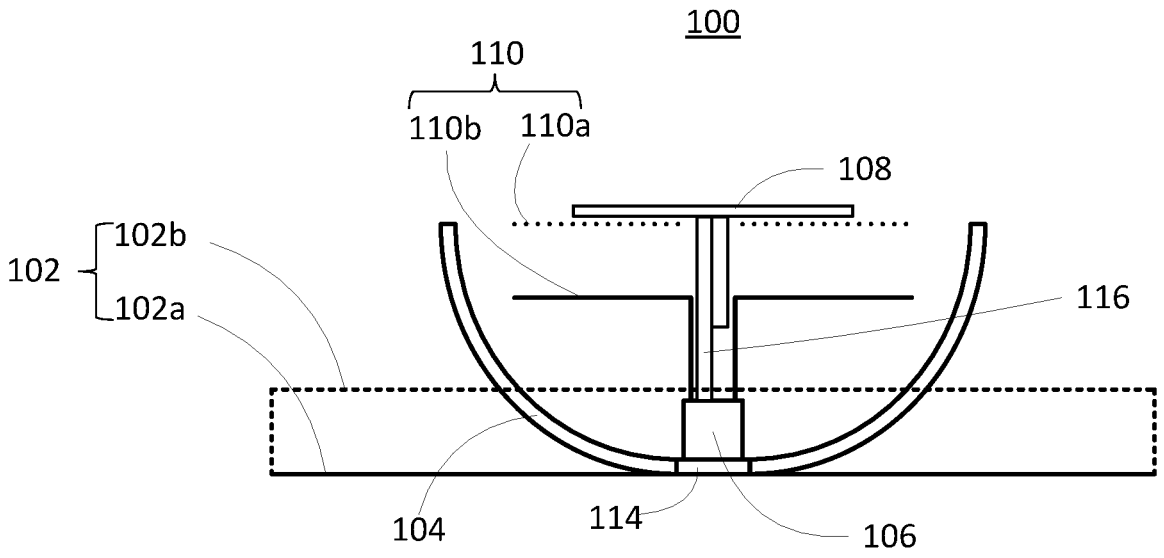

FIG. 1A is a cross-sectional view of a radiation system according an exemplary embodiment of the present invention.

Figure 1B:
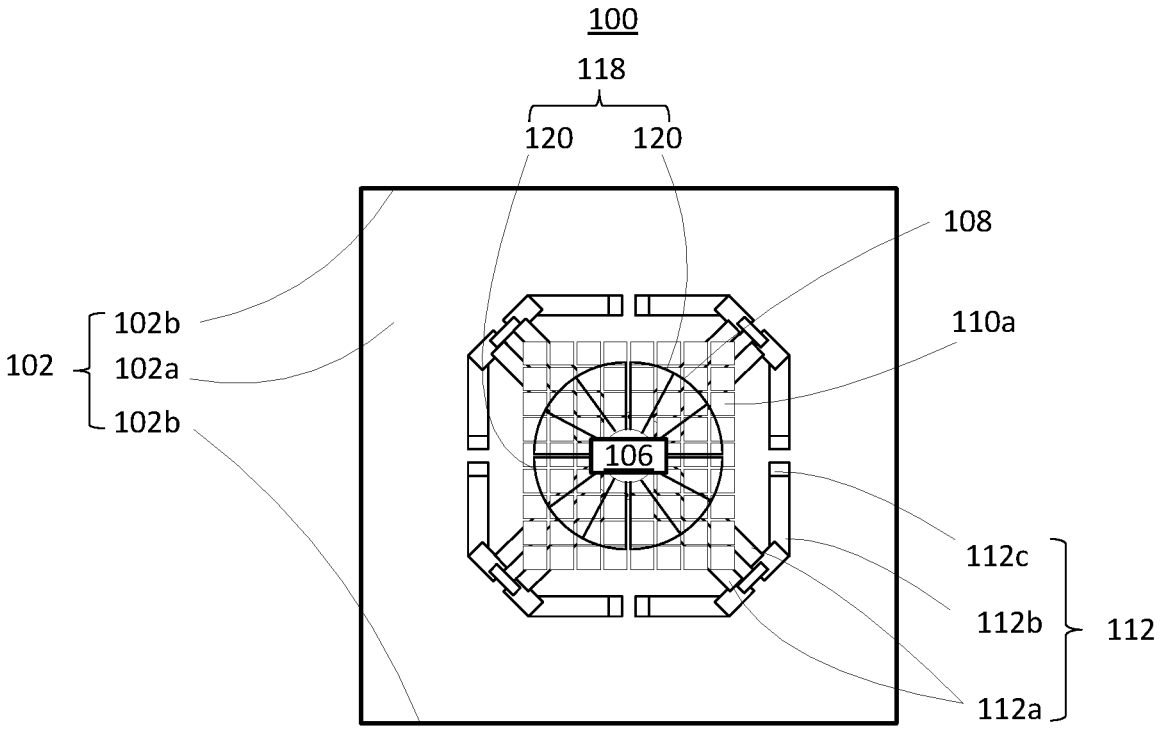

FIG. 1B is a plan view of the radiation system according the exemplary embodiment of the present invention.

Figure 1C:
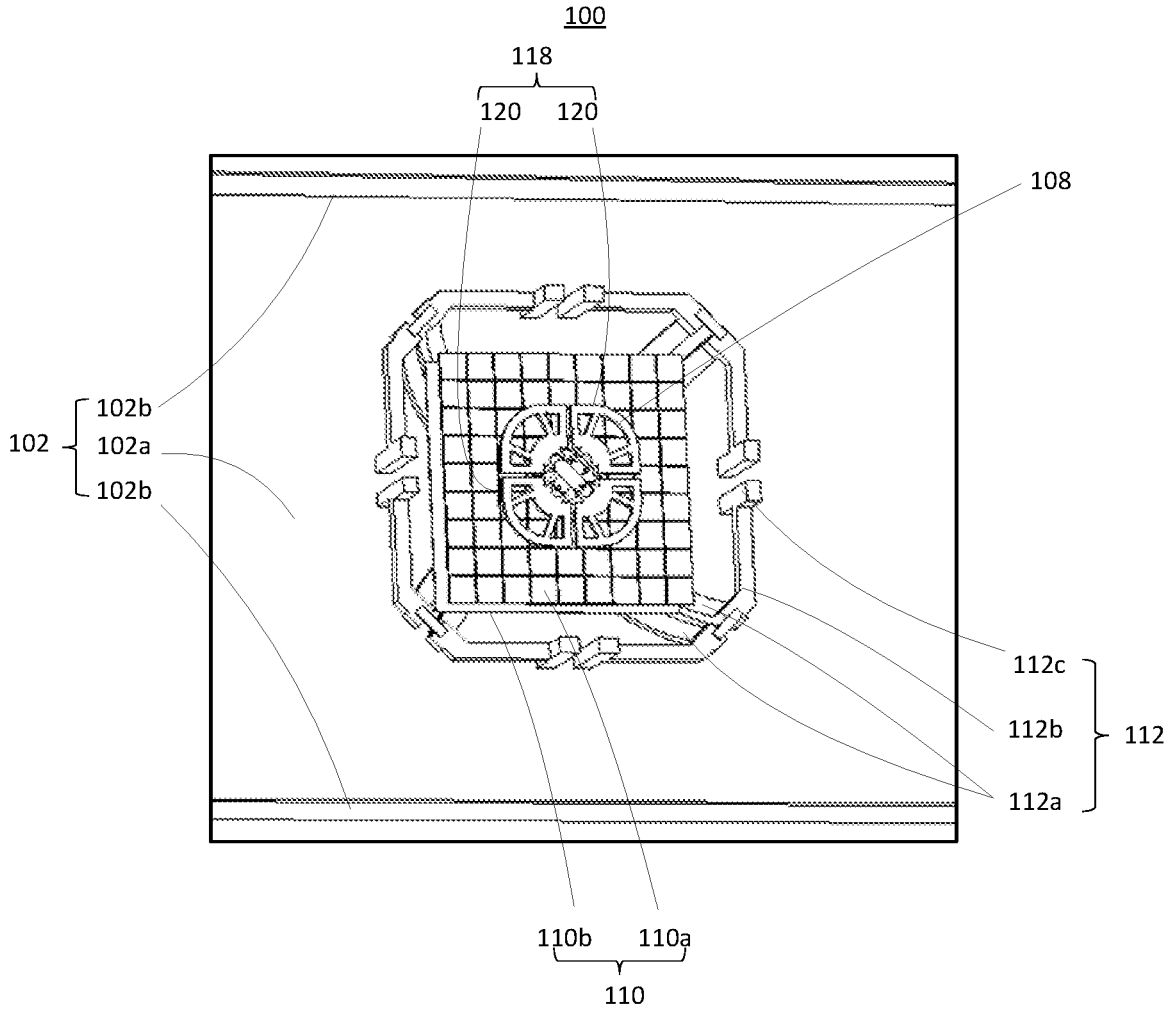

FIG. 1C is a perspective view of the radiation system according the exemplary embodiment of the present invention.

Figure 2:
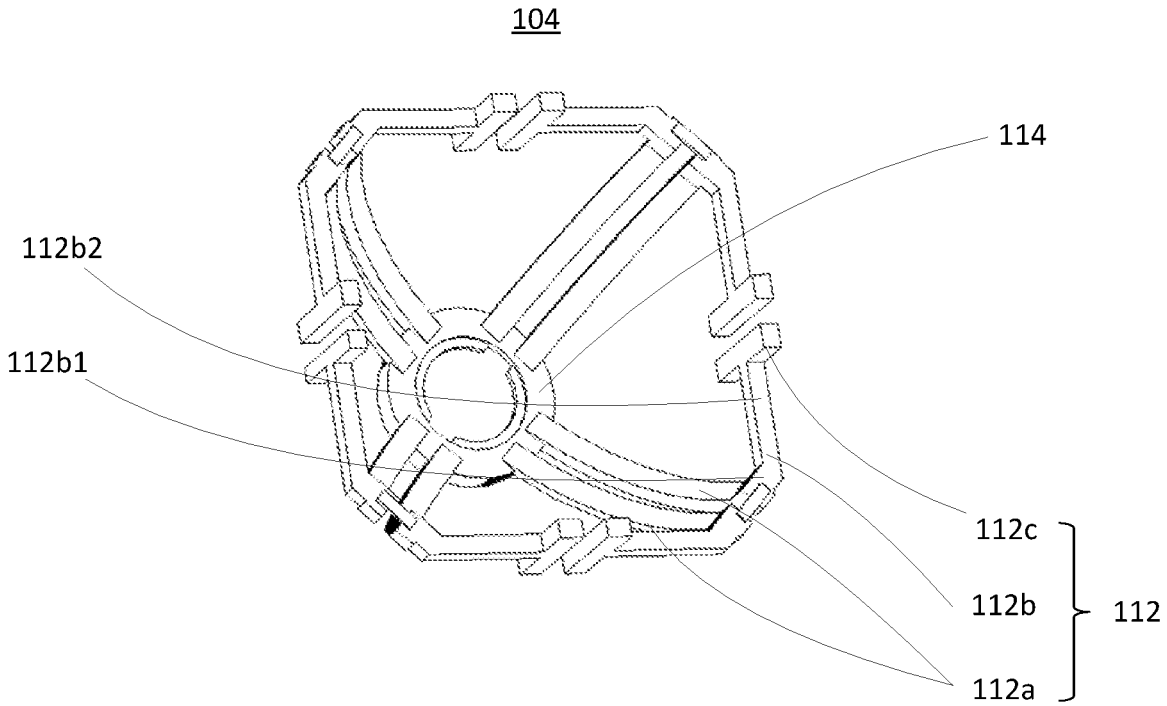

FIG. 2 is a perspective view of a low-frequency radiator in the radiation system in FIGS. 1A-1C.

Figure 3:
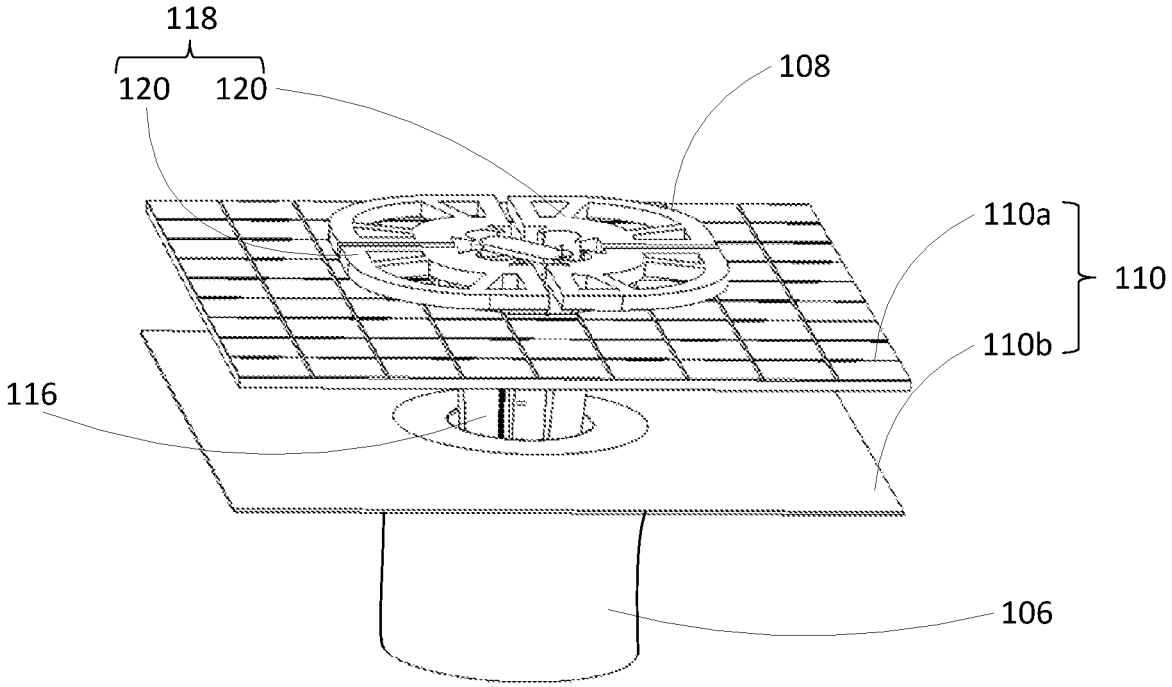

FIG. 3 is a perspective view of a portion of the radiation system in FIGS. 1A-1C.

Figure 4:
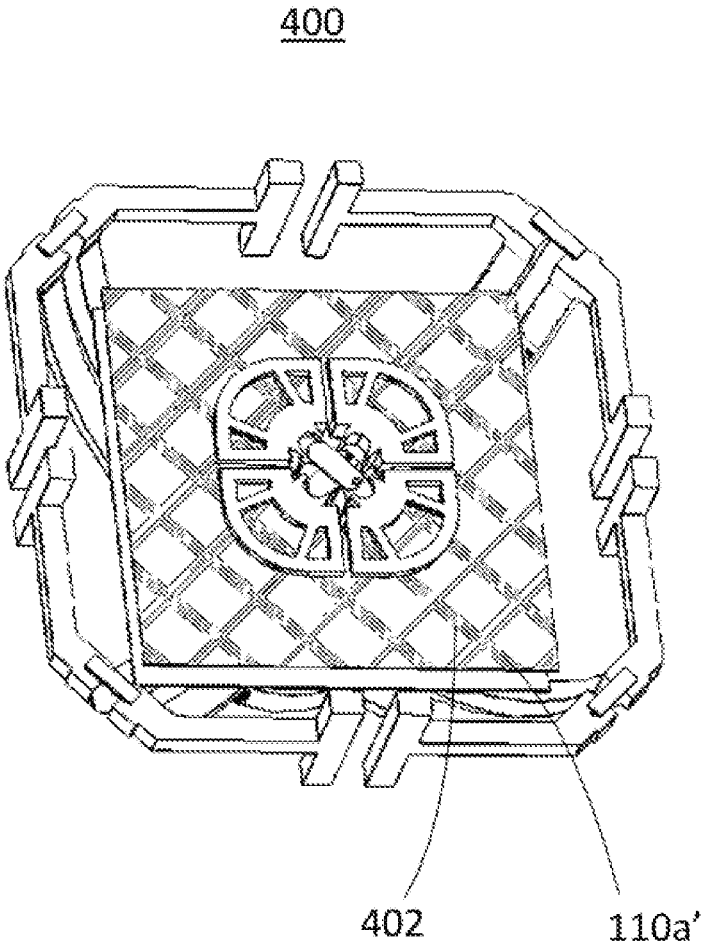

FIG. 4 is a perspective view of a portion of a radiation system according to another exemplary embodiment of the present invention.

Figure 5:
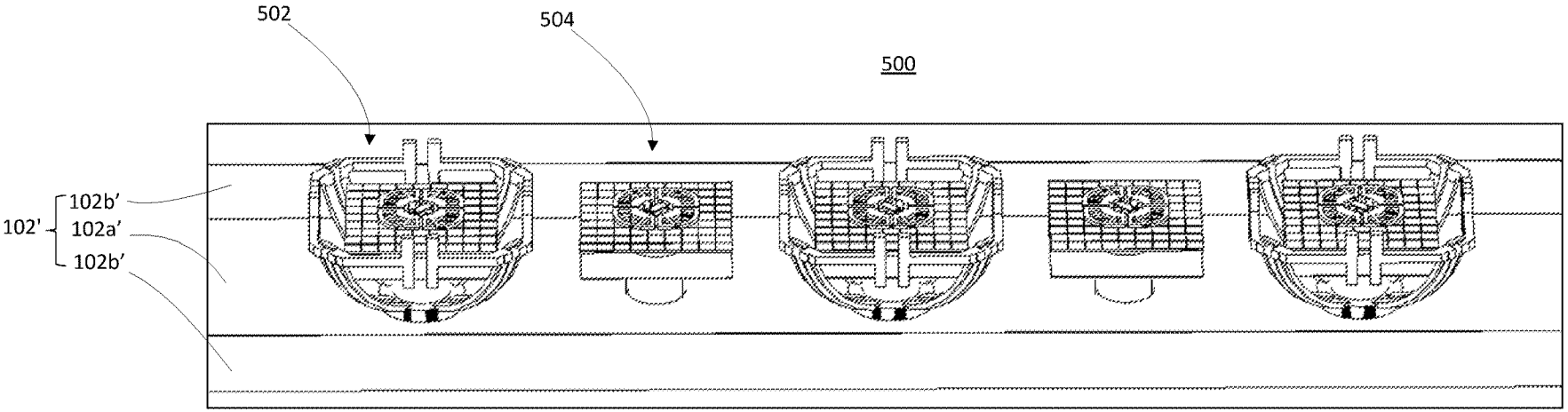

FIG. 5 is a perspective view of an antenna array according to an exemplary embodiment of the present invention.

BEST MODE FOR CARRYING OUT THE INVENTION

Best Mode

Embodiments consistent with the disclosure include a radiation structure working in two wave bands.

Hereinafter, embodiments consistent with the disclosure will be described with reference to the drawings. Wherever possible, the same reference numbers will be used throughout the drawings to refer to the same or like parts.

FIGS. 1A-1C schematically show an exemplary radiation system 100 in accordance with an embodiments of the present disclosure. FIGS. 1A-1C are a cross-sectional view, a plan view, and a perspective view of the radiation system 100, respectively. The radiation system 100 includes a reflector 102, also referred to herein as a lower reflector 102, a low-frequency radiator 104 formed over the reflector 102, a system base 106 formed at the bottom of the low-frequency radiator 104, a high-frequency radiator 108 formed over the system base 106, and a metamaterial reflector 110, also referred to herein as an upper reflector 110, formed beneath the high-frequency radiator 108. A center frequency of the radiation spectrum of the low-frequency radiator 104 is lower than a center frequency of the radiation spectrum of the high-frequency radiator 108. For example, the center frequency of the low-frequency radiator 104 is about 830 MHz and the center frequency of the high-frequency radiator 108 is about 2.2 GHz. As shown in, e.g., FIG. 1A, the low-frequency radiator 104 has a bowl-shaped structure. In some embodiments, the low-frequency radiator 104, the system base 106, the high-frequency radiator 108, and the metamaterial reflector 110 are arranged coaxially along the vertical direction.

According to the present disclosure, the reflector 102 includes a main reflecting board 102*a* formed beneath the low-frequency radiator 104. The main reflecting board 102*a* can be, for example, a solid metal board. In some embodiments, as shown in FIG. 1A, the main reflecting board 102*a* is parallel or approximately parallel to the high-frequency radiator 108 and the metamaterial reflector 110.

In some embodiments, the reflector 102 further includes one or more auxiliary reflecting boards 102*b*, such as one, two, or three auxiliary reflecting boards 102*b*. In some embodiments, the reflector 102 does not include any auxiliary reflecting board. According to the present disclosure, the auxiliary reflecting board 102*b* is arranged at a certain angle $\varphi$ relative to the main reflecting board 102*a*. The angle $\varphi$ can be, for example, in a range from about 90° to about 180°. The auxiliary reflecting board 102*b* can have, for example, a square shape, a semicircular shape, or a serration shape, and can be, for example, a solid metal board or a pierced metal board. In some embodiments, the auxiliary reflecting board 102*b* may include a dielectric slab and a metal array attached to the dielectric slab. The metal array includes a plurality of regular or irregular metal pieces arranged in an array according to a certain order.

In the example shown in FIGS. 1A-1C, the reflector 102 includes two auxiliary reflecting boards 102*b* arranged perpendicular to the main reflecting board 102*a*. In the cross-sectional view of FIG. 1A, one of the two auxiliary reflecting boards 102*b* is shown and is represented by dashed lines. In some embodiments, the two auxiliary reflecting boards 102*b* are arranged parallel to each other, and a distance between the two auxiliary reflecting boards 102*b* is about $0.4\lambda_L$ to about $0.8\lambda_L$, where $\lambda_L$ is the working wavelength of the low-frequency radiator 104, i.e., the wavelength corresponding to the center frequency of the radiating spectrum of the low-frequency radiator 104. The center frequency of the radiating spectrum of the low-frequency radiator 104 can be, for example, about 830 MHz. A height of each of the auxiliary reflecting boards 102*b* is from about $0.05\lambda_L$ to about $0.2\lambda_L$.

FIG. 2 is a perspective view of the low-frequency radiator 104 in accordance with embodiments of the present disclosure. As shown in FIG. 2, the low-frequency radiator 104 includes a dual polarized radiation device having four conductive dipole radiating components 112 formed on a radiator base 114. As shown in FIGS. 1B, 1C, and 2, each of the dipole radiating components 112 includes a pair of baluns 112*a* connected with the radiator base 114. Each of the baluns 112*a* is connected with an array arm 112*b*. A loading section 112*c* is fixed at an end of the array arm 112*b*. Two dipole radiating components 112 that are arranged rotationally symmetric to each other with respect to the vertical center line of the low-frequency radiator 104 constitute a dipole.

According to the present disclosure, each of the array arms 112*b* includes a first arm section 112*b*1 and a second arm section 112*b*2. One end of the first arm section 112*b*1 is fixed at the corresponding balun 112*a*, and the other end of the first arm section 112*b*1 is connected to the second arm section 112*b*2. The internal angle between the first and second arm sections 112*b*1 and 112*b*2 equals or is smaller than about 135°. The loading section 112*c* is arranged on the upper surface and the lower surface at the end of the second arm section 112*b*2. In some embodiments, the sum of the physical length of the first arm section 112*b*1, the physical length of the second arm section 112*b*2, and the effective length of the loading section 112*c* equals about $0.25\lambda_L$. As an exemplary embodiment as shown in FIG. 1C and FIG. 4, there are a pair of loading sections 112*c* parallel to and spaced from each other, each loading section 112*c* of the pair is vertical to the array arms 112*b* or forms an angle therebetween, and is located at the free end of each second arm section 112*b*2 extending upwards and downwards to a certain length from the free end of each second arm section 112*b*2.

Referring again to FIG. 1A, the system base 106 is formed over the radiator base 114 of the low-frequency radiator 104, with the lower portion of the system base 106 connected to the radiator base 114. In some embodiments, the lower end of the system base 106 is directly connected to the reflector 102. The upper end of the system base 106 is connected to a surface of a balun 116 that feeds electricity to the high-frequency radiator 108. FIG. 3 is a perspective view of a portion of the radiation system 100, showing the system base 106, the high-frequency radiator 108, and the metamaterial reflector 110. As shown in FIG. 3, the system base 106 has a cylinder shape. A portion of the balun 116 is positioned inside the cylinder-shaped system base 106.

According to the present disclosure, the system base 106 is provided to position and hold the high-frequency radiator 108 at a relatively high level. In some embodiments, the height of the system base 106 is chosen so that a radiation plane of the high-frequency radiator 108 is at about the same level as or slightly lower than a radiation plane of the low-frequency radiator 104. As such, the radiation system 100 can have a small size.

The high-frequency radiator 108 can include one or more radiating components, and can be any type of radiator, such as, for example, a dipole antenna, a bow-tie antenna, or a patch antenna. In the example shown in the drawings, the high-frequency radiator 108 includes a dipole antenna having two dipoles 118. The polarizations of the two dipoles 118 are orthogonal or approximately orthogonal to each other, such that the high-frequency radiator 108 can have two polarized radiations that are orthogonal or approximately orthogonal to each other. As shown in FIGS. 1B, 1C, and 3, each of the dipoles 118 includes two conductive radiating components 120 arranged opposing to each other, i.e., the two conductive radiating components 120 are arranged rotationally symmetric to each other with respect to a vertical center line of the high-frequency radiator 108. In some embodiments, as shown in FIGS. 1B, 1C, and 3, each of the conductive radiating components 120 includes a fan-shaped structure, with a side length of about $0.15\lambda_h$ to about $0.25\lambda_h$, where $\lambda_h$ is the working wavelength of the high-frequency radiator 108, i.e., the wavelength corresponding to the center frequency of the radiating spectrum of the high-frequency radiator 108. The center frequency of the radiating spectrum of the high-frequency radiator 108 can be, for example, about 2.2 GHz.

According to the present disclosure, the balun 116 feeds electricity to the high-frequency radiator 108. As shown in FIGS. 1A and 3, the balun 116 is arranged co-axial to the high-frequency radiator 108. As described above, the lower portion of the balun 116 is coupled to the system base 106 and positioned in a hole of the system base 106, as shown in FIG. 3. In some embodiments, the length of the balun 116 is about $0.25\lambda_h$.

Referring to FIGS. 1A-1C, and 3, the metamaterial reflector 110 includes a metasurface 110*a*, which is represented by a dotted line in the cross-sectional view of FIG. 1A. As used herein, "metamaterial" refers to a material formed by engineering a base material to have properties that the base material may not have. A metamaterial usually includes small units that are arranged in patterns, at scales that are smaller than the wavelengths of the phenomena the metamaterial influences. A metasurface is also referred to as an "electromagnetic metasurface," which refers to a kind of artificial sheet material with sub-wavelength thickness and electromagnetic properties on demand.

According to the present disclosure, the metasurface 110*a* is arranged beneath the high-frequency radiator 108, i.e., lower than a lower surface of the high-frequency radiator 108. In some embodiments, the distance between the metasurface 110*a* and the lower surface of the high-frequency radiator 108 is between about $0.01\lambda_h$ and about $0.15\lambda_h$. In some embodiments, the metasurface 110*a* is parallel or approximately parallel to the lower surface of the high-frequency radiator 108. In some embodiments, the metasurface 110*a* forms a certain angle, such as an angle within a range of about −15° to about +15°, with respect to the lower surface of the high-frequency radiator 108.

In some embodiments, the area of the metasurface 110*a* is designed to be as large as possible, but is slightly smaller than the aperture size of the low-frequency radiator 104. Further, the area of the metasurface 110*a* is slightly larger than the aperture size of the high-frequency radiator 108. The metasurface 110*a* is not connected to the high-frequency radiator 108 or the low-frequency radiator 104. For example, the metasurface 110*a* is electrically isolated from the high-frequency radiator 108 and the low-frequency radiator 104.

The metasurface 110*a* can be a flat surface or a curved surface, and can include a single sheet of metamaterial or a composite sheet having a plurality of sub-sheets of metamaterial. In some embodiments, the metasurface 110*a* is arranged on a thin di-electric slab, such as a foam slab, (not shown), and the dielectric slab is fixed inside the bowl-shaped structure of the low-frequency radiator 104. The metasurface 110*a* (in the case of single sheet) or each of the sub-sheets of the metasurface 110*a* (in the case of composite sheet) includes a plurality of metal plates arranged in a same surface. The shape and the arrangement of the metal plates can be uniform or non-uniform. That is, the metal plates can have different sizes or can have a similar or same size. In some embodiments, each of the metal plates has a size that is much smaller than $\lambda_h$, and preferably, the metal units each have a size smaller than about $0.25\lambda_h$, such as about $0.2\lambda_h$ or smaller than about $0.2\lambda_h$ in each dimension. For example, each of the metal plates can be a square metal plate having dimensions of about $0.2\lambda_h \times 0.2\lambda_h$. Further, the metal plates can be arranged in a regular array or can be arranged randomly. Moreover, at least two neighboring metal plates are separated by an interval. In some embodiments, each metal plate is separated from a neighboring metal plate by an interval smaller than about $0.1\lambda_h$. For example, the interval between two neighboring metal plates can be about $0.01\lambda_h$. The intervals between neighboring metal plates can be different from each other, or can be similar to or same as each other. For example, at least two pairs of neighboring metal plates have different intervals.

As shown in FIGS. 1A, 1C, and 3, the metamaterial reflector 110 further includes a metal reflecting plane 110*b* arranged beneath the metasurface 110*a*. In some embodiments, the metal reflecting plane 110*b* is parallel or approximately parallel to the metasurface 110*a*. The distance between the metasurface 110*a* and the metal reflecting plane 110*b* is smaller than about $0.2\lambda_h$. In the example shown in FIGS. 1A, 1C, and 3, the metasurface 110*a* and the metal reflecting plane 110*b* are spaced apart from each other without another material sandwiched therebetween. In other embodiments, a dielectric material, such as an FR4 (Flame Retardant Fiberglass Reinforced Epoxy Laminates) material substrate, can be provided between the metasurface 110*a* and the metal reflecting plane 110*b*.

In some embodiments, the metal reflecting plane 110*b* can have a similar or same size as the metasurface 110*a*. In some embodiments, the metal reflecting plane 110*b* is slightly smaller than the metasurface 110*a*. In some embodiments, a side length of the metal reflecting plane 110*b* is smaller than about $0.3\lambda_L$, to avoid influence on the radiation performance of the low-frequency radiator 104. On the other hand, since the metasurface 110*a* has a relatively larger area, the metasurface 110*a* has a larger influence on the high-frequency radiator 108. That is, the metasurface 110*a* and the metal reflecting plane 110*b* together can reflect most of the radiation of the high-frequency radiator 108 toward a direction away from the low-frequency radiator 104.

As shown in, e.g., FIGS. 1A and 3, each of the metasurface 110*a* and the metal reflecting plane 110*b* has a hole for the balun 116 to pass through. The balun 116 does not directly contact the metasurface 110*a* but can directly contact the metal reflecting plane 110*b*.

According to the present disclosure, the metamaterial reflector 110 including the metasurface 110*a* and the metal reflecting plane 110*b* forms a good magnetic conductor for radiation within a certain frequency band, i.e., within the working frequency band of the high-frequency radiator 108, and provides isolation between the low-frequency radiator 104 and the high-frequency radiator 108. This magnetic conductor changes the boundary condition of the high-frequency radiator 108, and thus improves the radiation performance of the high-frequency radiator 108 by increasing the gain of the high-frequency radiator 108. Further, as described above, the meta-material reflector 110 has very little influence on the radiation performance of the low-frequency radiator 104. That is, with the use of the metamaterial reflector 110, the radiation performance of the high-frequency radiator 108 can be improved without sacrificing the radiation performance of the low-frequency radiator 104. Moreover, because of the metamaterial reflector 110, the high-frequency radiator 108 can be arranged inside the bowl-shaped structure of the low-frequency radiator 104, and thus the overall height of the radiation system 100 can be reduced.

In the example shown in, e.g., FIGS. 1B, 1C, and 3, and described above, the metasurface 110*a* includes a plurality of square-shaped metal plates. That is, each of the units forming the metasurface 110*a* is a square-shaped metal plate. The square shape can be a solid square shape or a hollow square shape, i.e., a square frame. The units forming the metasurface consistent with the present disclosure can, however, have other shapes, such as a solid or hollow rectangular shape, a solid or hollow circular shape, an L-shape, or a spiral shape. FIG. 4 is a perspective view of a portion of another exemplary radiation system 400 consistent with embodiments of the present disclosure. In FIG. 4, the lower reflector 102 is not shown. The radiation system 400 is similar to the radiation system 100, except that the radiation system 400 includes a metasurface 110*a*' that has a plurality of square-frame metal units 402, i.e., each of the metal units 402 has a "square ring" shape.

FIG. 5 is a perspective view of an exemplary antenna array 500 consistent with embodiments of the present disclosure. The antenna array 500 includes at least one dual-band radiation unit 502 and at least one single-band radiation unit 504 arranged alternately on a reflector 102', also referred to herein as a lower reflector 102'. The reflector 102' is similar to the reflector 102, and also includes a main reflecting board 102*a*' and two auxiliary reflecting boards 102*b*' arranged perpendicular or approximately perpendicular to the main reflecting board 102*a*'. Similar to the reflector 102, the reflector 102' can also include no auxiliary reflecting board, only one auxiliary reflecting board, or more than two auxiliary reflecting boards. Further, an angle between the main reflecting board 102*a*' and each of the auxiliary reflecting boards 102*b*' can also be in the range from about 90° to about 180°.

The dual-band radiation unit 502 is similar to the portion of the radiation system 100 without the reflecting board 102. That is, the dual-band radiation unit 502 is associated with two radiation bands a low frequency band and a high frequency band. On the other hand, the single-band radiation unit 504 is similar to the high-frequency portion of the radiation system 100, i.e., the portion shown in FIG. 3, which includes the system base 106, the high-frequency radiator 108, and the metamaterial reflector 110. In some embodiments, the radiation plane of the single-band radiator 504 is on a same plane as the radiation plane of the high-frequency portion of the dual-band radiator 502. This arrangement facilitates the radiation pattern synthesis.

It is understood, a radiation system can be provided in accordance with the embodiment of the present invention, comprise a radiator, such as the high-frequency radiator 108, or even the low-frequency radiator 104, and a metamaterial reflector 110 arranged below a lower surface of the radiator. The metamaterial reflector 110 comprises a metasurface 110*a* arranged below the lower surface of the radiator and a solid metal plane 110*b* arranged below the metasurface.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A radiation system, comprising:

a low-frequency radiator having a bowl-shaped structure;

a high-frequency radiator arranged inside the bowl-shaped structure of the low-frequency radiator; and a metamaterial reflector arranged below the high-frequency radiator and inside the bowl shape structure of the low-frequency radiator and comprising:

a metasurface arranged below the high-frequency radiator; and a solid metal plane arranged below the metasurface.

2. The radiation system of claim 1, wherein a distance between the metasurface and a lower surface of the high-frequency radiator is in a range from $0.01\lambda_h$ to $0.15\lambda_h$, where $\lambda_h$ is a working wavelength of the high-frequency radiator.

3. The radiation system of claim 1, wherein a distance between the metasurface and the solid metal plane is smaller than $0.2\lambda_h$, where $\lambda_h$ is a working wavelength of the high-frequency radiator.

4. The radiation system of claim 1, wherein the metamaterial reflector further comprises a dielectric material sandwiched between the metasurface and the solid metal plane.

5. The radiation system of claim 1, wherein the metasurface is smaller than an aperture size of the low-frequency radiator and larger than an aperture size of the high-frequency radiator.

6. The radiation system of claim 1, wherein the metasurface comprises a flat plane.

7. The radiation system of claim 1, wherein the metasurface comprises a curved plane.

8. The radiation system of claim 1, wherein the metasurface comprises a plurality of metal units arranged in a plane, the metal units each having a size smaller than about $0.25\lambda_h$, where $\lambda_h$ is a working wavelength of the high-frequency radiator.

9. The radiation system of claim 8, wherein at least two neighboring ones of the metal units are separated from each other by an interval.

10. The radiation system of claim 8, wherein the metal units are arranged in a regular array.

11. The radiation system of claim 8, wherein the metal units are arranged randomly.

12. The radiation system of claim 8, wherein at least two of the metal units have different sizes or shapes.

13. The radiation system of claim 8, wherein each of the metal units has one of a rectangular shape, a circular shape, an L-shape, a spiral shape, or a square frame shape.

14. The radiation system of claim 8, wherein the metasurface further comprises a dielectric slab, and the metal units are arranged on the dielectric slab.

15. The radiation system of claim 1, wherein the metasurface comprises a plurality of sub-planes, and each sub-plane comprises a plurality of metal units arranged in a plane, the metal units each having a size smaller than $0.25\lambda_h$, where $\lambda_h$ is a working wavelength of the high-frequency radiator.

16. The radiation system of claim 1, wherein a side length of the solid metal plane is smaller than $0.3\lambda_L$, where $\lambda_L$ is a working wavelength of the low-frequency radiator.

17. The radiation system of claim 1, wherein a radiation plane of the high-frequency radiator is at a same level as or is slightly lower than a radiation plane of the low-frequency radiator.

18. The radiation system of claim 1, further comprising:

a lower reflector arranged below the low-frequency radiator, the lower reflector comprising a main reflecting board arranged parallel to or approximately parallel to the metamaterial reflector.

19. The radiation system of claim 18, wherein the lower reflector further comprises at least one auxiliary reflecting board, an angle between the main reflecting board and the at least one auxiliary reflecting board being in a range from 90° to 180°.

20. An antenna array, comprising: at least one dual-band radiation unit and at least one single-band radiation unit arranged alternately; wherein each of the at least one dual-band radiation unit comprises:

a low-frequency radiator having a bowl-shaped structure;

a first high-frequency radiator arranged inside the bowl-shaped structure of the low-frequency radiator; and a first metamaterial reflector arranged below the first high-frequency radiator and comprising: a first metasurface arranged below the first high-frequency radiator, and a first solid metal plane arranged below the first metasurface;

each of the at least one single-band radiation unit comprises:

a second high-frequency radiator; and a second metamaterial reflector arranged below the second high-frequency radiator and comprising: a second metasurface arranged below the second high-frequency radiator, and a second solid metal plane arranged below the second metasurface.

* * * * *